US010932625B2

(12) United States Patent
MacLean

(10) Patent No.: US 10,932,625 B2
(45) Date of Patent: Mar. 2, 2021

(54) POOL

(71) Applicant: The Good Birth Company Limited, Birmingham (GB)

(72) Inventor: Adam Charles MacLean, Birmingham (GB)

(73) Assignee: THE GOOD BIRTH COMPANY LIMITED, Birmingham (GB)

( * ) Notice: Subject to any disclaimer, the term of this patent is extended or adjusted under 35 U.S.C. 154(b) by 0 days.

(21) Appl. No.: 16/036,246

(22) Filed: Jul. 16, 2018

(65) Prior Publication Data

US 2019/0014952 A1 Jan. 17, 2019

(30) Foreign Application Priority Data

Jul. 14, 2017 (GB) ..... 1711347

(51) Int. Cl.
*A47K 3/022* (2006.01)
*A47K 3/062* (2006.01)
*A61H 33/00* (2006.01)

(52) U.S. Cl.
CPC ..... *A47K 3/022* (2013.01); *A47K 3/062* (2013.01); *A61H 33/6005* (2013.01); *A61H 2201/0157* (2013.01)

(58) Field of Classification Search
CPC ..... A47K 3/022; A47K 3/06; A47K 3/062; A47K 3/064; A47K 3/024; A61H 33/6005; A61H 2201/0107; A61H 2201/0157
See application file for complete search history.

(56) References Cited

U.S. PATENT DOCUMENTS 3,914,807 A * 10/1975 Palmer ..... A47K 1/14 4/287
4,118,810 A * 10/1978 Brickhouse ..... A47K 3/006 4/556
4,197,838 A * 4/1980 Shill ..... A61G 7/1003 4/541.3

(Continued)

FOREIGN PATENT DOCUMENTS

DE 29719277 U1 2/1998
DE 202014105549 U1 3/2015

(Continued)

OTHER PUBLICATIONS

English Abstract of JPH09322868.

(Continued)

*Primary Examiner* — J C Jacyna
(74) *Attorney, Agent, or Firm* — Caesar Rivise, PC

(57) ABSTRACT

An apparatus for water birthing in which an occupant of the tub is raised. The apparatus may include a tub, a stand and a connector, the tub having a floor with an outlet therethrough and a peripheral side wall, the stand being configured to support the tub, in use, at or adjacent a terminal edge or lip of the peripheral side wall such that the floor of the tub is spaced from the ground upon which the stand rests. The connector may be fluidly connected or connectable to the outlet, removably and fluidly connected or connectable to a drainage apparatus, and accessible during use of the water birthing apparatus. Assistants of an occupant of the tub have reduced distances to bend and/or reach when assisting (e.g. lifting or otherwise moving) the occupant.

20 Claims, 10 Drawing Sheets

(56) References Cited

U.S. PATENT DOCUMENTS

| | | | | | |
|---|---|---|---|---|---|
| 4,249,522 | A * | 2/1981 | Carrier | A61H 33/02 | 4/541.5 |
| 4,930,164 | A * | 6/1990 | Gibson | E03C 1/22 | 4/683 |
| 5,343,575 | A | 9/1994 | Cartwright | | |
| 6,473,915 | B1 * | 11/2002 | Davis | A47K 3/006 | 4/555 |
| 2004/0199994 | A1 * | 10/2004 | Sherif | A47K 3/022 | 4/622 |
| 2008/0022447 | A1 | 1/2008 | Krause et al. | | |
| 2009/0178191 | A1 * | 7/2009 | MacLean | A61G 13/0009 | 4/506 |
| 2011/0010843 | A1 * | 1/2011 | Galati, Jr. | A47K 3/022 | 4/622 |
| 2016/0213563 | A1 * | 7/2016 | Ta | E03C 1/186 | |

FOREIGN PATENT DOCUMENTS

| | | | |
|---|---|---|---|
| EP | 1138305 | * | 10/2001 |
| JP | H09322868 | A | 12/1997 |
| JP | 2001353089 | A | 12/2001 |

OTHER PUBLICATIONS

English Abstract of JP2001353089.
Cluett, and Burns, "Immersion in water in labour and birth", The Cochrane database of systematic reviews, vol. 2, CD000111, p. 1-55, (2009).
English Abstract of DE202014105549.
Search Report for corresponding British Application No. GB1711347.3 dated Jan. 11, 2018.

* cited by examiner

POOL

BACKGROUND OF THE INVENTION

Field of the Invention

This invention relates generally to a pool. More specifically, although not exclusively, this invention relates to a pool for water birthing.

Background Art

Water birthing has become increasingly popular in recent years as the benefits of this practice have become more widely known. Trials have shown that use of birthing pools during the initial stage of labour reduces the need for epidural and spineal analgesia (see Cluett E R. Burns E. Immersion in water in labour and birth. *Cochrane Database Syst Rev.* 2009(2)). Furthermore, it was found that immersion during the second stage of labour resulted in the mother reporting a generally higher level of satisfaction with the experience of child birth.

Water birthing has used standard baths but is now more commonly practiced in specially designed birthing pools comprising a tub, which is partially filled with water. These birthing pools are commonly located in hospitals, birth centres or midwifery units, although home births are also known. Some tubs are configured to cause the birthing mother to adopt a reclined or lithotomy position, with leg supports to retain the birthing mothers legs, examples are shown in DE202014105549U1 and U.S. Pat. No. 6,473,915. These pools are less suitable for use during the early stages of birthing when the user may be using the pool for pain relief and may not wish to be in a reclined or the lithotomy position. Moreover, many birthing mothers want to adopt an upright or squatting position when giving birth. Factors such as the ability of the birthing mother to have sufficient space to move freely within the pool, combined with the buoyancy of the water, may be beneficial for pain management. The above-identified pools are designed to limit the positional choice of the birthing mother. Additionally, pools often comprise hard, non-cushioned floors, which cause the birthing mother's knees to ache both during and after the birth, due to prolonged periods of time spent kneeling in the pool.

Water birthing comprises a mother-to-be entering the tub of a birthing pool, for example when she has entered the first (or a later) stage of labour. The tub may be filled with water either prior or subsequent to her entry thereinto. Health care professionals (such as midwives), and/or other assistants such as family members, generally assist the mother-to-be. These assistants are generally located outside of the tub. Accordingly, the assistants are required (during water birthing) to lean across the tub whilst lifting, holding or otherwise assisting the pregnant woman occupying the tub.

The water contained by the tub should have a temperature within acceptable bounds, where said water should not be too cold or too hot to avoid providing an uncomfortable (and possibly unsafe) experience for the mother-to-be and/or those assisting her. Additionally, elevation of the mother's core temperature caused by water that is too hot carries risks for the unborn baby. In some countries health care professionals may be trained to monitor the temperature of the water at regular intervals during the birth procedure. If the water temperature is found to be outside of the acceptable bounds additional water may be added to warm or cool the body of water within the tub. Such addition of water may be particularly necessary (and may occur several times) during protracted births.

Tubs generally comprise a floor and a peripheral side wall terminating in a rim which extends around the tub. Typically tubs may be located on a support surface with the rim about 50 to 55 cm above the surface to allow a user to step over the rim to enter the bath.

As will be appreciated, lifting or other types of assistance of a mother-to-be in the tub carry a risk of injury to the assistant(s) and/or to the mother-to-be. It is known for some birthing procedures to last a long time and hence the mother-to-be and/or the assistant(s) may become exhausted. Fatigued individuals have an enhanced risk of suffering injury and consequently birthing procedures of extended duration may carry an increased risk of injury to the mother-to-be and/or the assistant(s). Such risks are exacerbated by the requirement of the assistor to reach into and/or over the tub and for the assistor to lift weight (e.g. of the mother-to-be) which is spaced a distance from themselves, vertically and/or horizontally. Additionally, repeated and prolonged assistance of the mother-to-be in the tub is known to be uncomfortable to the assistors and/or may lead to repetitive strain injury over an extended period of time. Protracted birthing procedures increase the risk of the participants suffering from repetitive strain injury, as will be appreciated. Continually reaching into a tub which has a rim at the standard height above the support surface can cause discomfort to the assistant.

Subsequent to birth or use the water must be emptied from the tub and appropriately disposed of. The water may contain blood and/or other human matter and, accordingly, should be disposed of in a controlled manner according to the regulations of the jurisdiction within which the birthing procedure has occurred.

It is known that birthing pools and the water used in them may harbour bacteria. Such bacteria may infect subsequent users of the birthing pool: mother's-to-be or their assistants. Accordingly, it is known to clean birthing pools between uses. However, prior art birthing pools have been found to be difficult to adequately clean and therefore a risk of bacterial infection remains.

It is therefore a first non-exclusive object of the invention to provide a pool which mitigates one or more of the above-identified problems with prior art pools.

SUMMARY OF THE INVENTION

Accordingly, a first aspect of the invention provides an apparatus for water birthing, the apparatus comprising a tub, a stand and a connector, the tub having a floor with an outlet therethrough and a peripheral side wall, the stand being configured to support the tub, in use, at or adjacent a terminal edge or lip of the peripheral side wall such that the floor of the tub is spaced from the ground upon which the stand rests, wherein the connector is fluidly connected or connectable to the outlet, is removably and fluidly connected or connectable to a drainage apparatus and is accessible during use of the water birthing apparatus.

A further aspect of the invention provides an apparatus for water birthing, the apparatus comprising a tub, a stand and a connector, the tub having a floor with an outlet therethrough and a peripheral side wall, the stand being configured to support the tub, in use, such that the floor of the tub is spaced 200 mm or more from the surface upon which the stand rests, wherein the connector is fluidly connected or connectable to the outlet, is removably and fluidly connected or connectable to a drainage apparatus and is accessible during use of the water birthing apparatus.

There is therefore provided an apparatus for water birthing in which an occupant of the tub is relatively raised with respect to prior art water birthing apparatus. Advantageously, assistants of the occupant of the tub therefore have reduced distances to bend and/or reach when assisting (e.g. lifting or otherwise moving) the occupant of the tub, compared to using prior art apparatus for water birthing.

The floor of the tub may be spaced by 210, 220, 230, 240, 250, 260, 270, 280, 290, 300, 310, 320, 330, 340, 350, 360, 370, 380, 390, 400 mm or more above the surface upon which the stand rests. The higher the floor of the tub is spaced form the surface upon which the stand rests the easier it is to access the connector to remove drainage apparatus from the tub, but the higher the user has to climb to access the tub. Accordingly, we prefer a space of 210 or 220 to 480 mm, for example 250 to 450 mm, say 280 to 400 mm.

Advantageously, by elevating the floor of the tub the space to access the connector is increased. Moreover, the height of the head of water is increased, which means that drainage will occur at a faster rate, within the limits of any down-stream flow restrictions.

When the tub is supported by the stand, in use, the terminal edge of the peripheral side wall of the tub may have a height of greater than about 920 mm above the floor or ground or other surface upon which the stand rests. For example, the terminal edge of the peripheral side wall of the tub may have a height of greater than about 925, 930, 935, 940, 945, 950, 955, 960, 965, 970, 975, 980, 985, 990, 995, or 1000 mm above the floor or ground or other surface upon which the stand rests. We prefer a height of less than 1200 mm, say less than 1100 mm and in embodiments less than 1050 mm for reasons of transportability and ease of access.

Preferably, the stand supports the tub at or adjacent a terminal edge or lip of the peripheral side wall of the tub. In embodiments, the stand supports the tub around the entire terminal edge of the tub. In embodiments the stand is of a fixed height, meaning the stand is not capable of elevation to raise the tub so that the distance between the lowermost portion of the stand and the uppermost portion of the tub remains constant.

Advantageously, by elevating the terminal edge of the peripheral side wall, as compared to other pools, an assistant may well have to bend less to assist the birthing mother.

The floor of the tub may comprise a sloped portion, for example which may be configured to be sloped or inclined relative to the floor or ground or other surface upon which the stand rests, when the tub is supported by the stand. The sloped portion may comprise a major portion of the floor. The sloped portion of the floor of the tub may be planar, e.g. substantially. The terminal edge of the tub may define a first plane. The sloped portion of the floor of the tub may define a second plane. The second plane may be non-parallel (e.g. inclined) to the first plane. The sloped portion may comprise a lowermost portion of the floor, when the tub is supported by the stand, in use. The sloped portion may slope toward the outlet. The outlet is preferably located at the lowermost portion of the floor to facilitate drainage. Advantageously, the floor of the tub, for example the sloped portion, is free of projections which might hinder a user from adopting a certain position within the tub.

The tub may comprise an out-turned lip at the terminal edge, for example the out-turned lip being configured to be engaged, in use, by an abutment member of the support to thereby support the tub. The support may comprise one or more support members, e.g. having a ground engaging member at one edge and an or the abutment member at the opposed edge. The one or more support members may comprise a support wall, for example configured, in use, to surround the peripheral side wall of the tub (e.g. to extend around a major portion of the peripheral side wall of the tub).

The tub may be ovular in plan, for example substantially ovular. The tub may comprise a first and second ends with sides extending therebetween.

The tub may comprise one or more bracing means or portions, for example for allowing an occupant of the tub to position, reposition and/or orient themselves with respect to the tub. The bracing means or portions may be positioned at or adjacent and/or extend at least partially across the intersection of the floor and the peripheral side wall of the tub. The bracing means or portions may be spaced substantially evenly about the tub, for example about the circumference thereof. The bracing means or portions may be located adjacent or spaced from one or more end portions of the tub. The bracing means or portions may be integrally formed with the tub, for example moulded therewith. In embodiments, however, the bracing means or portions may be attached or attachable (e.g. secured or securable) to the tub. Where the bracing means or portions are attached to the tub this may be during manufacture thereof, for example using suitable securing or affixing means or securements or affixments known to the skilled person, e.g. by means of adhesive.

The bracing means or portions may comprise one or more projections, for example projecting from the floor and/or peripheral side wall of the tub. The one or more projections may comprise one or more ribs. In embodiments, there may be two, three, four or more bracing means or portions; preferably there are two bracing means or portions. Where there are two bracing means or portions they may be arranged or positioned substantially opposed to one another, e.g. for enabling an occupant of the tub to brace, in use, their feet thereagainst. Where there are two bracing means or portions they may be arranged or positioned on or at the sides of the tub (e.g. and spaced from the ends thereof), where the tub comprises sides and ends.

The tub may comprise one or more orientation means or points, for example which may be configured and/or arranged to allow an occupant of the tub to adjust and/or control their position within the tub. The orientation means or points may comprise one or more rebates, for example into the tub (e.g. into the side wall and/or terminal edge thereof). One some or each of the rebates may be substantially wedge shaped. The orientation means or points may comprise one or more grips or hand holds. The orientation means or points may be located at and/or adjacent a terminal edge or lip of the peripheral side wall of the tub. There may be two or more orientation means or points. Where there are two orientation means or points they may be located on the tub to be substantially opposed to one another. Advantageously, where both orientation means or points and bracing means or portions are provided they may provide a synergistic effect enabling enhanced and/or relatively more accurate and/or rapid control of the position of an occupant of the tub.

The tub may comprise a first or deep area or end, for example and a second or shallow area or end. The first or deep area or end may be configured to retain a greater depth of water, in use, than does the second or shallow area or end. The tub may comprise an immersion area, for example and a support area. The immersion area may have a greater area, in plan, than does the support area. The immersion area may have an area, in plan that is more than twice that of the support area. The immersion area may comprise the first or deep area or end of the tub. The support area may comprise the second or shallow area or end of the tub. The distance between the floor of the tub and the floor or ground or other surface upon which the stand rests, when the stand supports the tub, in use, may comprise a deep end distance at the deep area or end. The immersion area of the tub may comprise the sloped portion of the floor of the tub.

The outlet may be through the sloped portion of the floor of the tub. The outlet may be disposed in a first or deep end of the tub.

The stand may comprise an aperture for passage therethrough of a drainage conduit. The stand may be arranged or arrangeable, in use, such that when the stand supports the tub the outlet of the tub is aligned with or adjacent to the aperture of the stand.

The apparatus for water birthing may comprise removable drainage apparatus, for example connected or connectable to the connector. The removable drainage apparatus may be removably connected or connectable to the connector by push fit. The removable drainage apparatus may comprise a valve means or valve, for example arranged or arrangeable to selectively allow or prevent fluid flow through the outlet. The removable drainage apparatus may comprise a removable drainage conduit. The connector, valve means or valve (where provided) and/or the removable drainage conduit (where provided) may comprise a smooth bore, for example a substantially smooth bore.

The connector may comprise a first end fluidly connected or connectable to the outlet of the floor of the tub, for example and a second end fluidly and removably connected or connectable to the drainage apparatus. The connector may have a length, e.g. defined by the distance between the first and second ends. The length of the connector may be configured to be less than the distance by which the floor of the tub is spaced from the floor or ground or other surface upon which the stand rests when the stand supports the tub, in use. Preferably the connector comprises a smooth-bore conduit through which water held within the tub can drain. The provision of a smooth-bore conduit facilitates cleaning and/or disinfecting.

The apparatus for water birthing may comprise a housing or enclosure, for example for the drainage apparatus. The housing or enclosure may completely or partially surround and/or enclose the drainage apparatus. The housing or enclosure may be arranged and/or configured to protect the drainage apparatus, e.g. from impact damage thereto. The housing or enclosure may be attached or attachable to the stand. The housing or enclosure may be at least partially integrally formed with the stand. The housing may be openable and/or removable to allow access to the drainage apparatus, in use. In embodiments, the housing or enclosure may comprise one or more movable portion or panel, for example that is openable (e.g. by means of a hinge or any other suitable mechanism) or removable relative to or from the remainder of the housing or enclosure. Advantageously, the housing or enclosure may mitigate damage to the drainage apparatus during use of the apparatus for water birthing. The housing or enclosure may be lockable or may be free of any locking mechanism or lock.

The apparatus for water birthing may comprise a screen, for example arranged or arrangeable to filter fluid flow, in use, through the outlet. The screen may be shaped and/or sized to fit within and/or on or over or across the outlet. The screen may be configured to extend across the flow path through the outlet. The screen may be removably installed or installable in, on and/or over the outlet.

The apparatus for water birthing may comprise ingress and egress means or apparatus, for example for entering and egressing the tub.

The tub may comprise an internal ledge, for example for seating an occupant of the tub, in use, and/or for aiding ingress into and/or egress from the tub. The internal ledge may be integral with the tub, e.g. may be integrally formed therewith. The ingress and egress means or apparatus may comprise the internal ledge. The internal ledge may be located in the or a shallow end of the tub. The internal ledge may comprise at least a part of or be the support area.

The apparatus for water birthing may comprise a step means or apparatus, e.g. for assisting a user of the apparatus to enter or exit the tub. The step means or apparatus may be located or locatable external to the tub. The step means or apparatus may comprise a first side which is shaped or configured to at least partially conform to the shape of the outer surface of the tub and/or support. The step means or apparatus may comprise a hand rail. The step means or apparatus may comprise a separate component from the support and/or tub. The ingress and egress means or mechanism may comprise the step means or apparatus.

The apparatus for water birthing may comprise a platform for supporting, in use, an assistant external to and/or adjacent the tub. The platform may comprise a cushioning layer. The platform may comprise a side surface which is shaped or configured to at least partially conform to the shape of an outer surface of the tub and/or support.

The apparatus for water birthing may comprise a removable liner, for example configured or configurable to line, in use, the internal surfaces of the tub.

The removable liner may comprise a base portion from peripheral portions of which a wall portion extends. The base portion may comprise a screen and/or an outlet member, for example positioned in the base portion such that, when the liner is arranged to line the internal surface of the tub the outlet member is aligned or alignable with the aperture through the floor of the tub. The screen may be attached (e.g. non-removably or removably) to the base portion. The screen may be located over and/or in the outlet member. The screen may be configured (e.g. sized and shaped) to screen fluid flow through the outlet member.

The tub and/or the stand may be formed from a polymer. The tub and/or the stand may be formed by moulding, for example by injection moulding or by rotational moulding. The tub, the stand, the platform (where provided) and/or the step means or apparatus (where provided) may comprise modular components. The tub and/or the stand may be movable or transportable to and/or from a site of use. The apparatus for water birthing may be transportable in a disassembled condition to and/or from a site of use.

A further aspect of the invention provides a removable liner for lining a birthing tub, the removable liner comprising a base portion from peripheral edges of which a wall portion extends, the wall portion having a rim configured to engage, in use, with a distal edge of a side wall of a birthing tub, the base portion comprising a screen positioned in the base portion such that, when the liner is arranged, in use, to line the internal surfaces of the birthing tub the screen aligns or is alignable with an outlet through a floor of the birthing tub.

The screen may be attached to the base portion, e.g. non-removably or removably.

For the avoidance of doubt, any of the features described herein apply equally to any aspect of the invention.

A yet further aspect of the invention provides a water birth pool comprising a tub and a stand, the stand supporting the tub away from the surface on which the stand is located, the tub comprising an outlet and a connector extending away from the outlet, the birth pool further comprising disposable drainage apparatus fluidly connected to the connector, the disposable drainage apparatus having a valve to control flow from the outlet along the drainage apparatus.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one aspect or embodiment of the invention are applicable to all aspects or embodiments, unless such features are incompatible.

BRIEF DESCRIPTIONS OF THE DRAWINGS

Embodiments of the invention will now be described by way of example only with reference to the accompanying drawings in which.

DESCRIPTION OF THE PREFERRED EMBODIMENTS OF THE INVENTION

Figure 1:
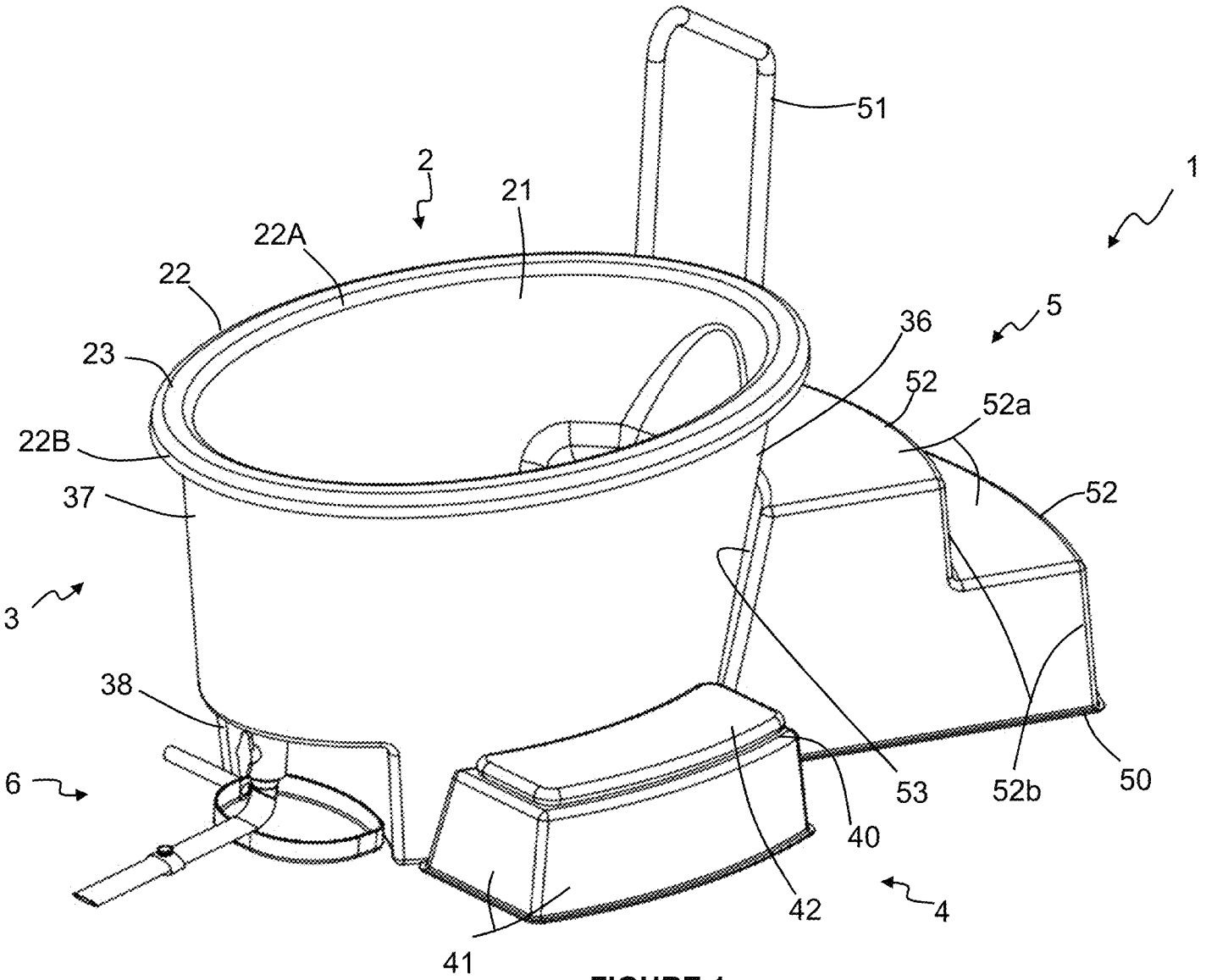
FIG. 1 is a perspective view of an apparatus for water birthing according to a first embodiment of the invention.
Figure 2:
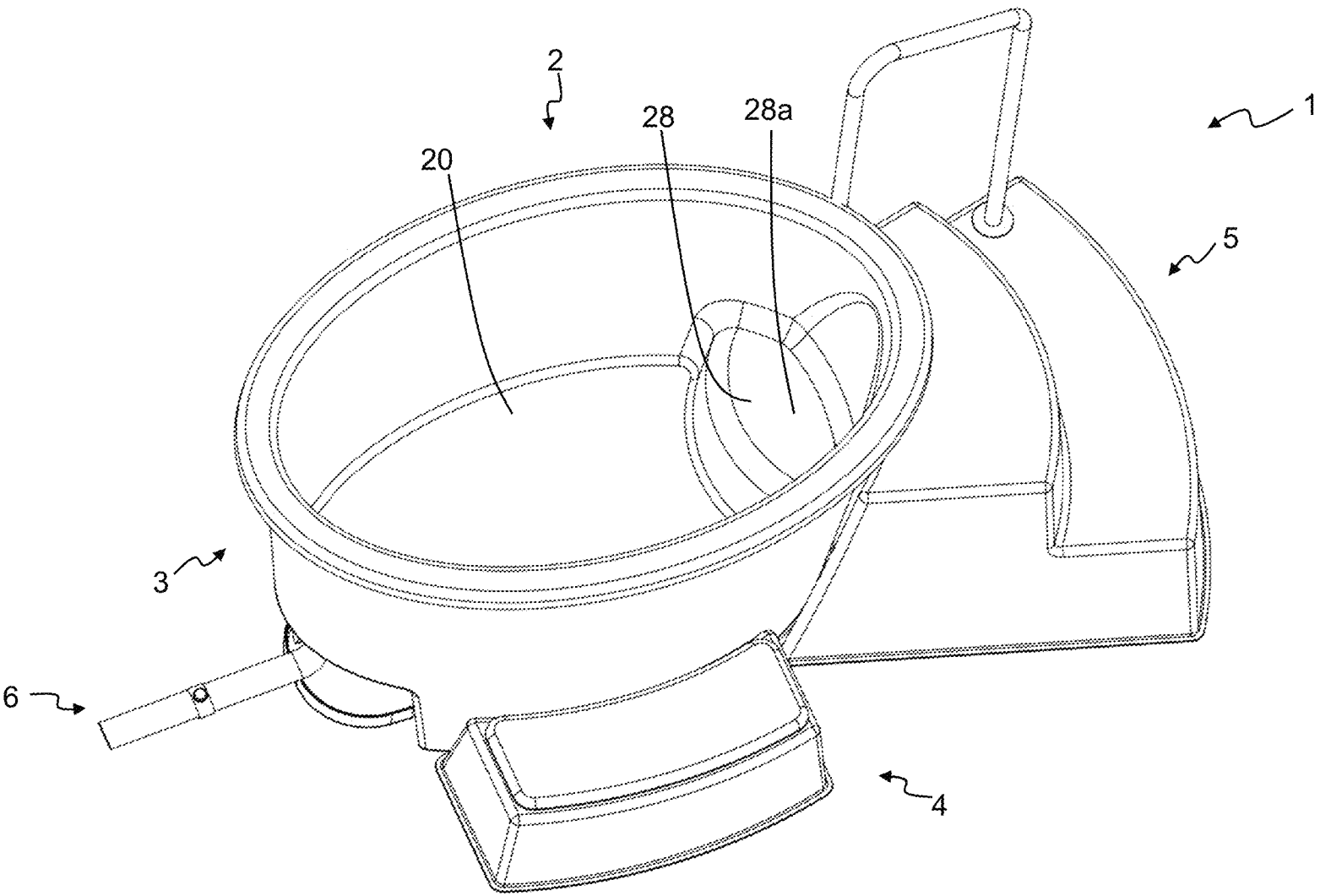
FIG. 2 is an alternative perspective view of the apparatus shown in FIG. 1.
Figure 3:
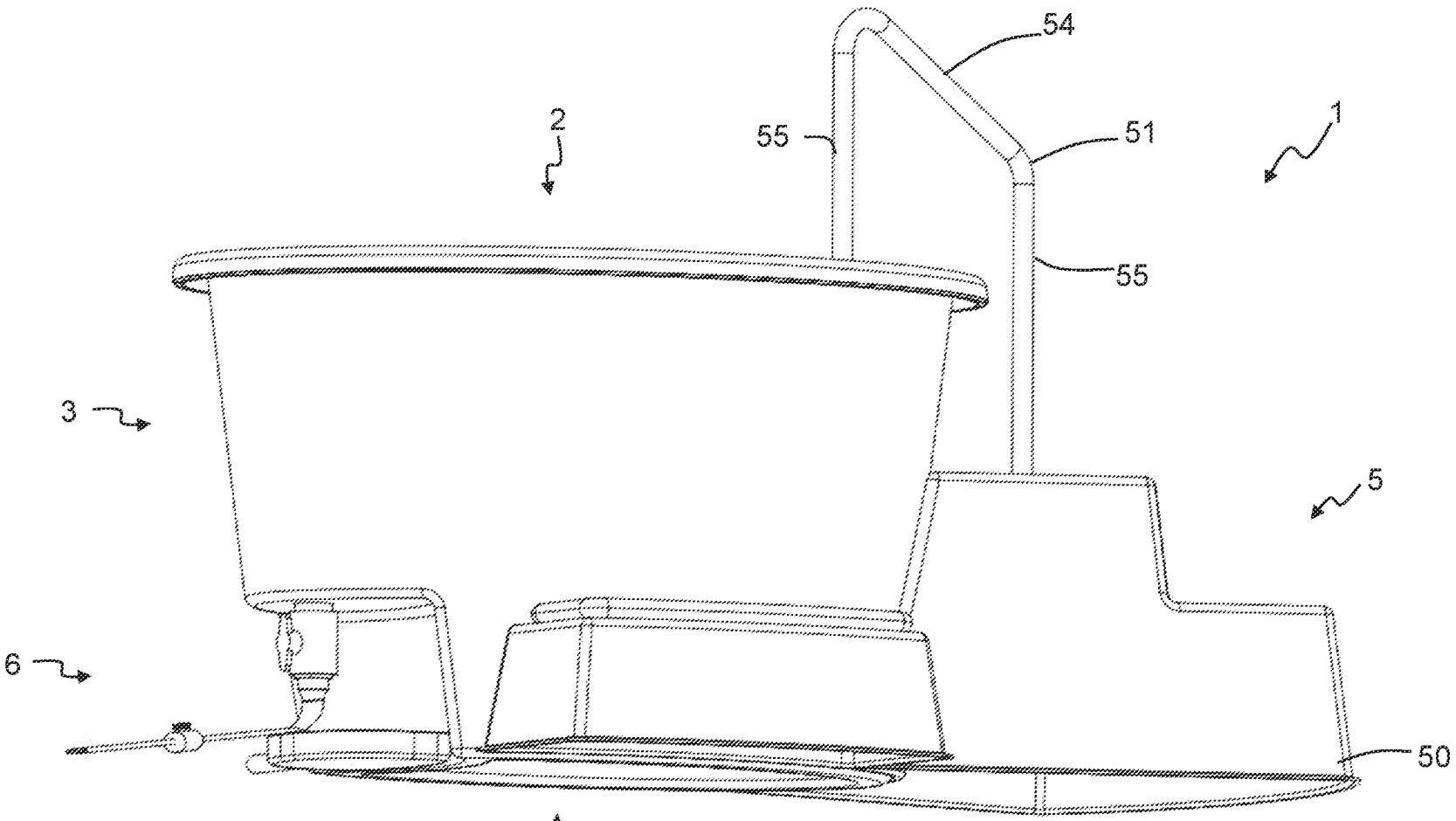
FIG. 3 is an alternative perspective view of the apparatus shown in FIG. 1.
Figure 4:
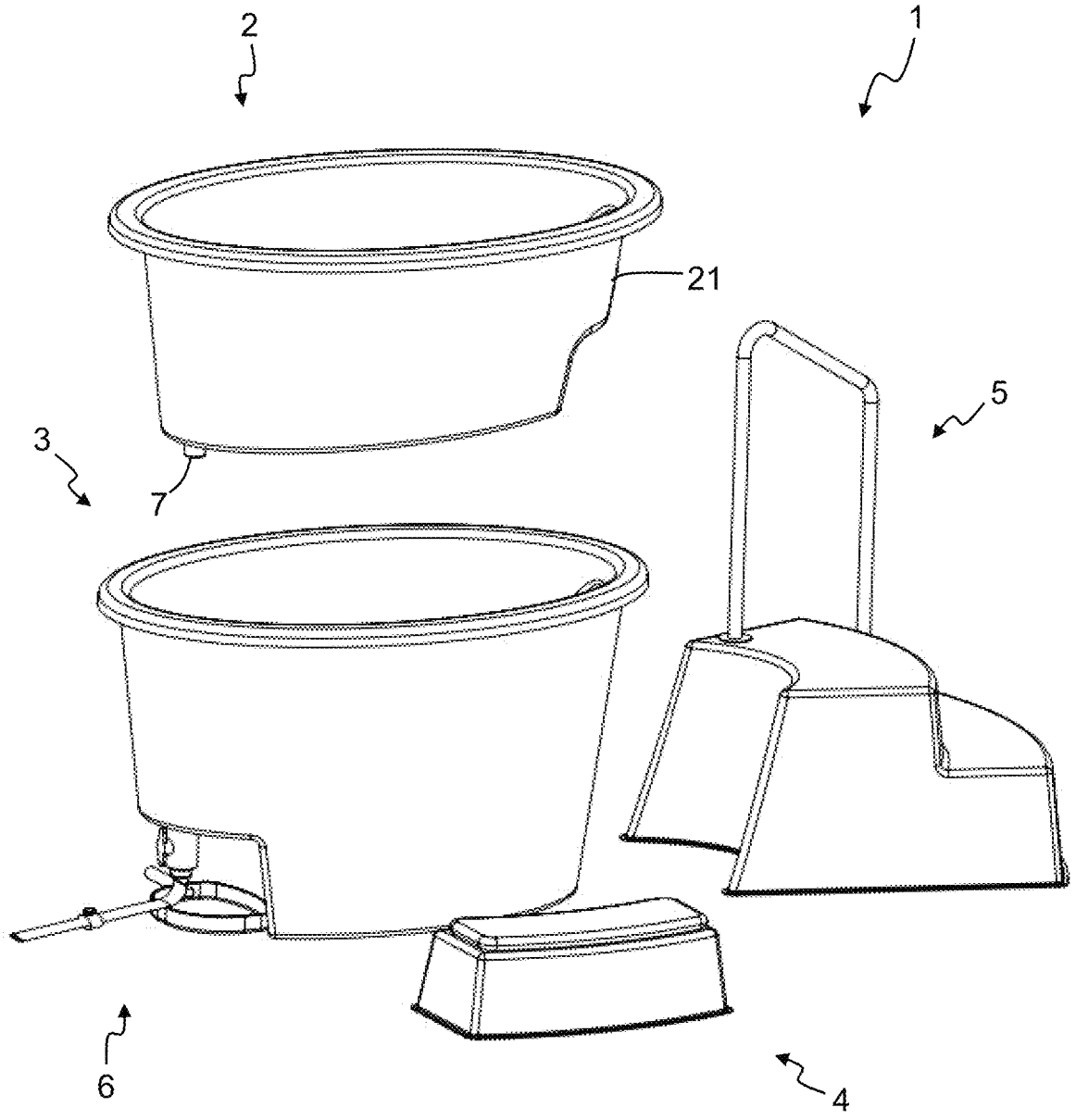
FIG. 4 is an exploded view of the apparatus shown in FIG. 1.
Figure 5:
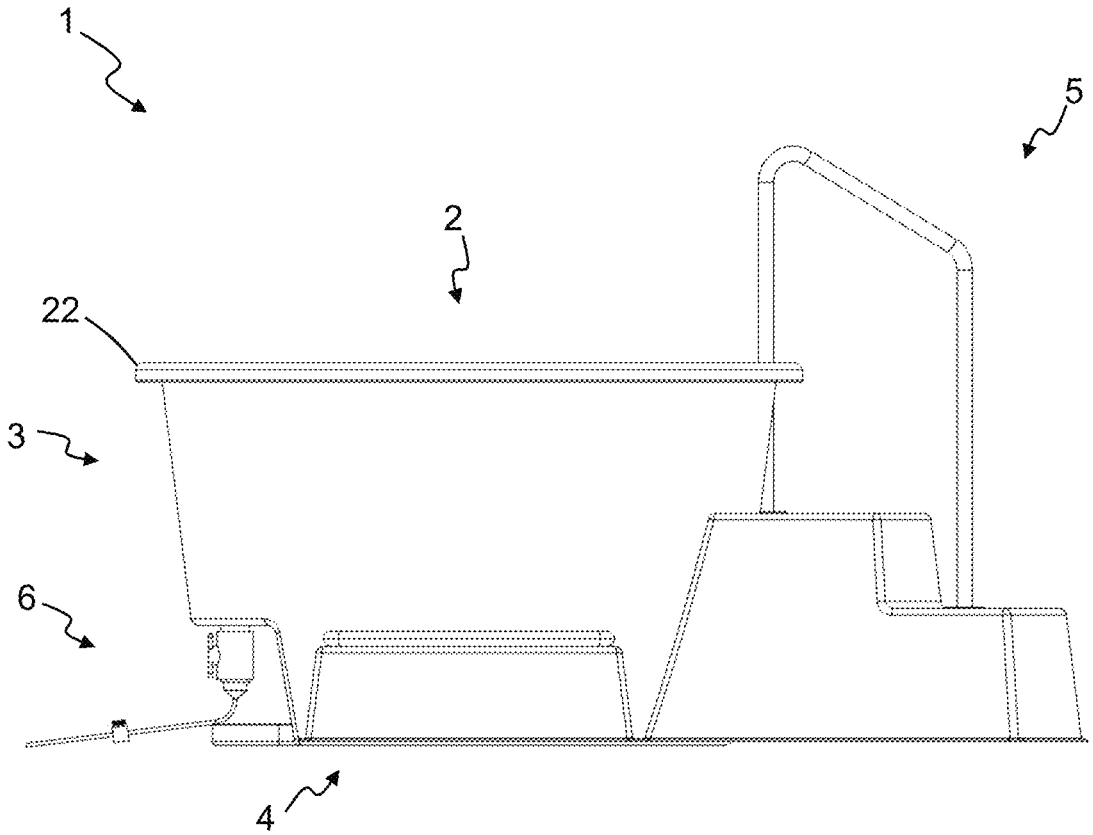
FIG. 5 is a side view of the apparatus shown in FIG. 1.

Referring now to FIGS. 1 to 8, there is shown an apparatus for water birthing 1 (e.g. a birthing pool) according to a first embodiment of the invention, comprising a tub 2, a stand 3, a platform 4 for kneeling, a step apparatus 5, and a drainage apparatus 6.

Figure 6:
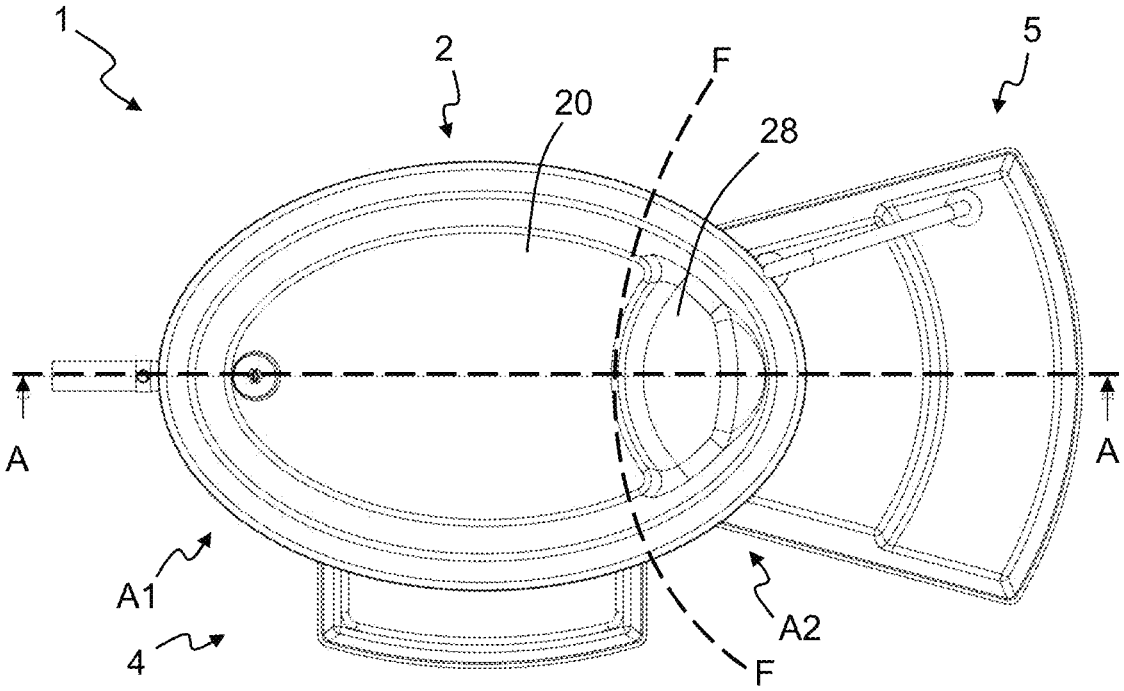
FIG. 6 is a plan view of the apparatus shown in FIG. 1.

The tub 2 comprises a floor 20, from a peripheral edge of which there extends a side wall 21. An out-turned lip 22 extends from the terminal edge 23 of the side wall 21 about the circumference of the tub 2. A return portion 24 extends from the out-turned lip 22, partially overlying the side wall 21. The tub 2 has an ovoid or oval shape, in plan (as best seen in FIG. 6). However, in embodiments, the tub 2 may have any suitable shape in plan, for example circular, polygonal, and the like. The tub 2 comprises an immersion area and a support area (as shown in FIG. 6 divided by line F). Importantly, to allow users to move relatively freely within the tub, the immersion area A1 has a greater area, in plan, than does the support area A2. The use of an ovoid or oval shape is beneficial because a user can move around the pool as the need arises, in contrast to the pools referenced above. When the tub 2 is an oval it may have a maximum length dimension x (in the direction of line A-A) and a maximum width dimension y (orthogonal to line A-A) and wherein $y \leq x \leq 2y$, preferably $1.3y \leq x \leq 1.8y$. By providing a pool within the above limits we believe the tub is highly suited for use as a birth pool.

As shown in FIG. 1, the tub 2 comprises an inner rebate 22A along the periphery of the side wall 21 and an outer rebate 22B along the terminal edge 23. Advantageously, the inner rebate 22A may be used as a holding point for the birthing mother to grip whilst moving into, out of, and within the tub 2. This enables greater manoeuvrability around and within the tub 2 by providing a secure and stable weight bearing point for supporting the birthing mother. An assistant may also use the inner rebate 22A and the outer rebate 22B whilst leaning into the tub to provide help to the mother and/or baby during labour and birth.

Figure 7:
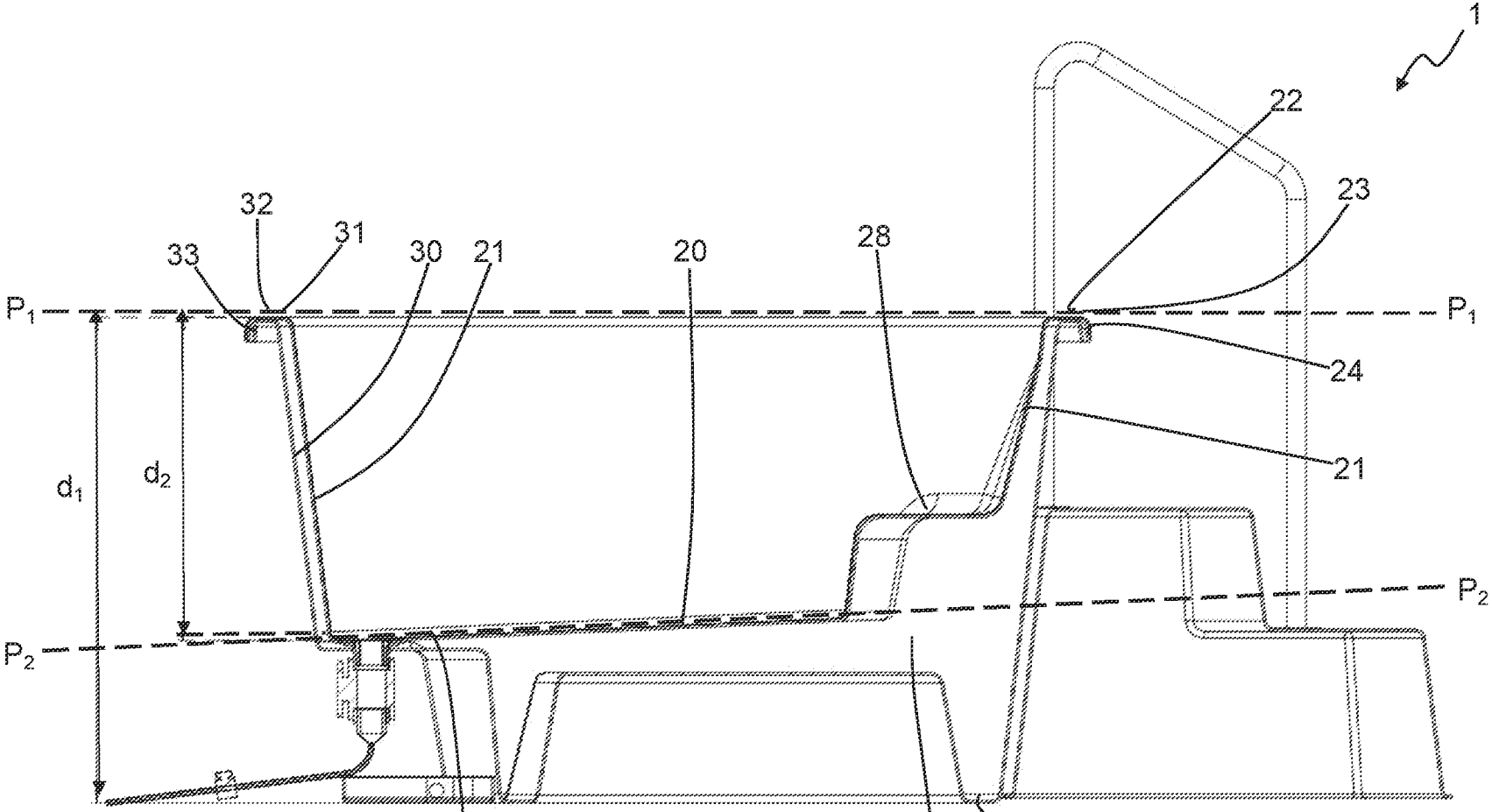
FIG. 7 is a sectional view along line A-A of FIG. 6.

As best shown in FIG. 7, the terminal edge 23 of the side wall 21 defined a first plane $P_1$. The major portion of the floor 20 defines a second plane $P_2$ which is inclined relative to the first plane $P_1$. The tub 2 comprises a first, 'shallow' end 25 and a second 'deep' end 26. The side wall 21 has a greater height at the second, deep end 26 of the tub 2 than it does at the first, shallow end 25 thereof.

Figure 8:
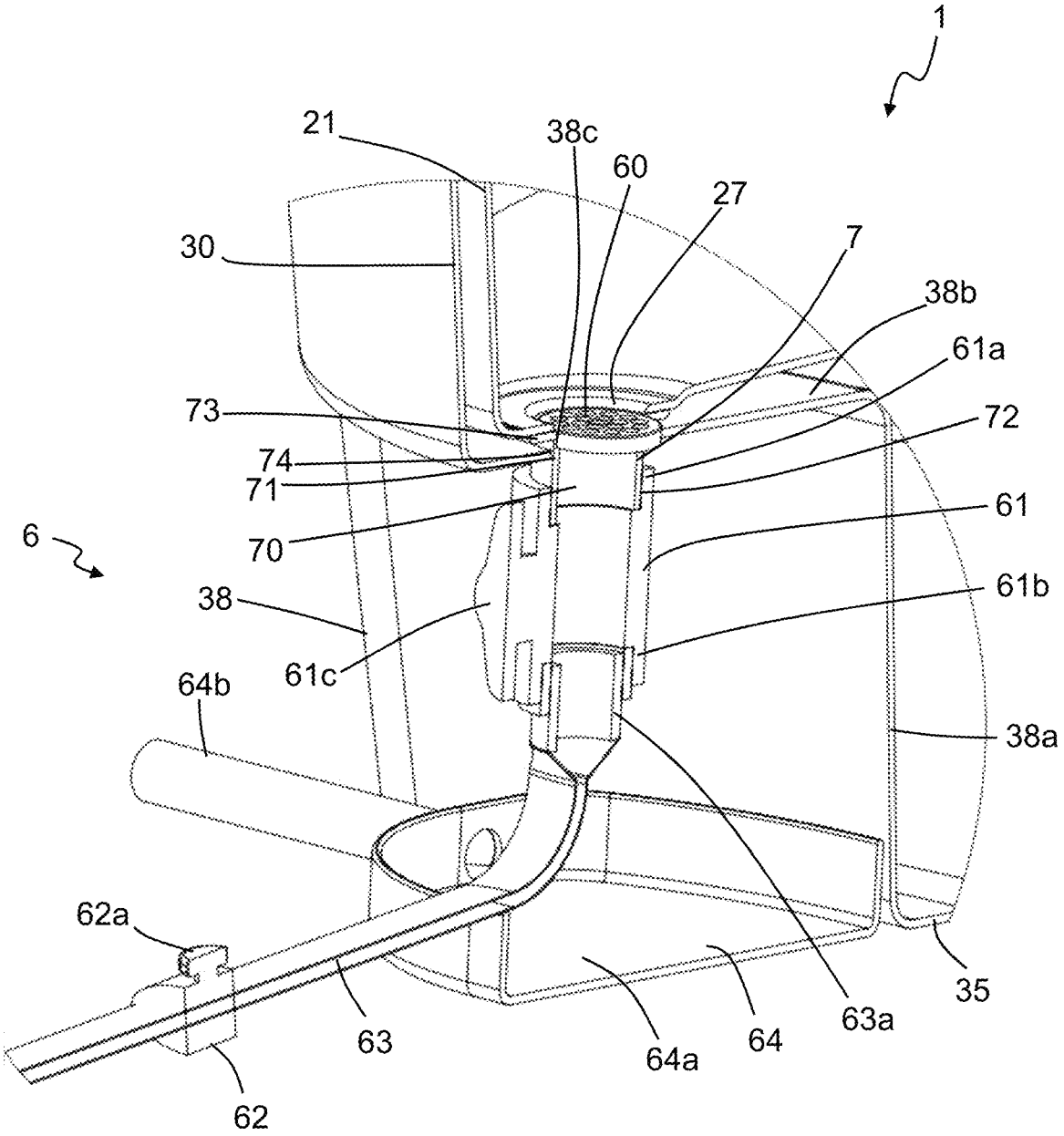
FIG. 8 is a partial sectional view of the apparatus shown in FIG. 1.

As best shown in FIG. 8, an outlet 27 is provided through the floor 20 of the tub 2, at the deep end 26 thereof. In this embodiment, the floor 20 of the tub 2 is partially countersunk surrounding the outlet 27. However, in embodiments the floor 20 of the tub 2 may be free from such countersinking.

A ledge 28 is located inside the tub 2, and is positioned toward the first, shallow end 25 thereof. The ledge 28 provides a support surface 28*a*, which is arranged such that a plane defined by the support surface 28*a* is substantially parallel to the plane P1 defined by the terminal edge 22 of the side wall 21. The support surface 28*a* can be used as a step or as a seat. Importantly, the floor 20 is free of projections which might hinder a user from adopting a certain position within the tub 2.

The stand 3 comprises a support wall 30 which is configured to surround, in use, the side wall 21 of the tub 2. The support wall 30 comprises a first edge 31 and an opposed, second edge 32. The first edge 31 of the support wall 30 comprises an abutment member 32, which, in this embodiment, is an out-turned, abutment lip 32. The out-turned abutment lip 32 comprises a return portion 33, partially overlying the support wall 30. In embodiments, the abutment member 32 may have any suitable shape and/or may comprise plural separate abutment portions.

The opposed, second edge 34 of the support wall 30 comprises a ground engaging member 35, which, in this embodiment, is an in-turned lip 35 (as shown in FIG. 8). Additionally or alternatively, in embodiments, the ground engaging member 35 comprises one or more foot portions. In embodiments, the support wall 30 comprises one or more interruptions around its surface. In embodiments, the support wall 30 is supplemented by one or more support columns. In embodiments, the support wall 30 is replaced by plural support columns. Where the support wall 30 is replaced by plural support columns, the columns are interconnected in order to provide structural rigidity.

The stand 3 comprises first and second ends 36, 37. The support wall 30 comprises a recessed portion 38 at the second end 37 of the stand 3, adjacent the second edge 34 of the support wall 30. The recessed portion 38 comprises a recessed support wall 38*a* connected to the main portion of the support wall 30 by a connection wall 38*b*. The connection wall 38*b* defines a plane which is substantially orthogonal to the main portion of the support wall 30. An aperture 38*c* is provided through the thickness of the connection wall 38*b*. The aperture 38*c* has a similar shape to that of the outlet 27 through the floor 20 of the tub 2, and has a size which is equal to or greater than the outlet 27. The aperture 38*c* through the connection wall 38*b* is positioned such that, when the tub 2 is positioned on and in the stand 3, with the second, deep end 26 of the tub 2 at the second end 37 of the stand 3, the outlet 27 in the floor 20 of the tub 2 aligns with the aperture 38*c* through the connection wall 38*b* of the stand 3 (as shown in FIG. 8).

The stand 3 is configured to surround the tub 2, in use. The stand 3 has a similar ovoid shape, in plan, to that of the tub 2, but with a slightly larger length and width. In embodiments, where the shape of the tub 2 is other than an ovoid the shape of the stand 3 will be similar to that of the tub 2 and will be configured to closely surround the tub 2.

The platform 4 for kneeling comprises a bearing surface 40 supported by platform walls 41. In embodiments, the bearing surface 40 may be supported by plural legs in addition or alternatively to the platform walls 41. The bearing surface 40 is provided with a cushioning layer 42, which may be formed from a foam or sponge and covered by a cover layer. One of the platform walls 41 is shaped to conform to the shape of the outer surface of a support wall 30 of the stand 3. In embodiments, platform walls 41 may extend around only part of the circumference of the bearing surface 40, for example one side of the bearing surface 40 may be free from a platform wall 41.

The step apparatus 5 comprises a stair portion 50 and a hand rail 51. The stair portion 50 comprises plural steps 52 (two, in this embodiment) positioned at different relative heights. In embodiments, the stair portion 50 may comprise a single step 52 or may comprise any suitable number of steps 52, for example three or more steps 52. Each step 52 comprises a tread surface 52*a* and a riser 52*b*. A step wall 53 obverse to the risers 52*b* is shaped to conform to the outer surface of the support wall 30 of the stand 3. In embodiments, the stair portion 50 may not include a step wall 53 obverse to the risers 52*b*. The hand rail 51 comprises a rail member 54 supported at either end by rail legs 55. The rail legs 55 are attached to the stair portion 50 at their free ends. The hand rail 51 may be formed from metal, e.g. stainless steel. In embodiments, the hand rail 51 may be formed from, or at least partially covered by a layer of, a polymer.

The tub 2, the stand 3, platform 4 and the stair portion 50 are preferably formed from a polymer and, in embodiments, are formed by injection or rotational moulding.

The apparatus for water birthing 1 comprises a connector 7 for connecting the outlet 27 of the tub 2 to the drainage apparatus 6.

The connector 7 comprises a tube 70 having a first, sealing end 71 and a second, connection end 72. The first, sealing end 71 comprises, in this embodiment, a sealing member which comprises a flange 73 which extends radially and outwardly. The flange 73 is secured to the floor 20 of the tub 2 such that it surrounds the outlet 27 in a fluid tight sealing manner. Securement of the connector 7 to the floor 20 of the tub 2 may be effected by any suitable means, for example using adhesive, etc. The bore of the tube 70 includes an annular rebate 74 at an adjacent the first, sealing end 71. The bore of the connector is smooth and substantially free from interruptions and/or projections.

As shown in more detail in FIG. 8, the drainage apparatus 6 comprises a screen member 60, a first valve 61, a second valve 62, a drainage tube 63 and a spillage collector 64.

The screen member 60 comprises a grill 60 in this embodiment. The grill 60 is shaped and sized to fit within the annular recess 74 in the bore of the connector 7, and to extend across the width of said bore. Prior to use, the grill 60 is removably installed within the first, sealing end 71 of the connector 7. Apertures through the grill 70 are sized in order to allow, during drainage, a relatively free flow of water therethrough but to prevent the passage of contaminating matter, such as faecal matter.

The first valve 61 is an isolating valve, in this embodiment, and includes first and second connection sockets 61*a*, 61*b*. In embodiments, the first valve 61 may be any suitable type of valve, for example it may be a pinch valve, gate valve or the like. The first valve 61 comprises a control member 61*c* on its outer surface for controlling opening and closing of the first valve 61. The second valve 62 is a pinch valve, in this embodiment, and is located or locatable about the drainage tube 63, in use. The second valve 62 comprises a control member 62*a* on its outer surface for controlling operation of the second valve 62.

The drainage tube 63 comprises a first, attachment end 63*a* and a second, distal end (not shown) for positioning at a waste water disposal destination. The drainage tube 63 is preferably formed from plastic tubing, which, in this embodiment, is at least partially deformable. The first, attachment end 63*a* of the drainage tube 63 is formed, in this embodiment, from a relatively more rigid material than is the remainder of the drainage tube 63. In this embodiment, the drainage tube 63 has a substantially flat cross-section when fluid is not flowing therethrough (e.g. when the tube 63 is not at least partially inflated). However, in embodiments, the drainage tube 63 may have any suitable cross-sectional shape when fluid is not flowing therethrough, for example circular, ovoid, and the like.

The spillage collector 64 comprises a drip tray 64*a* with an outlet conduit 64*b* extending from one side thereof. The outlet conduit 64*b* is connected or connectable at its free end (not shown) to a waste water disposal destination. In embodiments, the spillage collector 64 is provided without an outlet conduit 64*b* and instead the drip tray 64*a* is configured to retain any waste water spilled thereinto, prior to its disposal therefrom. The drip tray 64*a* is sized and shaped to be positioned, in use, underneath the outlet 27 in the floor 20 of the tub 2.

Prior to use, the apparatus 1 is transported to a site of use, typically in a disassembled condition. The apparatus 1 is then assembled at the site of use, for example at the home of a mother-to-be or in a hospital. The connector 7 is secured to the floor 20 of the tub 2, as described above. The stand 3 is then positioned on a substantially flat surface. The tub 2 is installed on and in the stand 3, such that the out-turned abutment lip 32 of the stand supports 3 the out-turned lip 22 of the tub 2. In this way the tub 2 is supported by the stand 3 with the floor 20 of the tub 2 spaced from the ground upon which the stand 3 rests. The first, connection end 72 of the connector 7 extends through the aperture 38*c* in the connection wall 38*b* of the stand 3. The first, connection socket 61*a* of the first valve 61 is attached to the connector 7 by push fit onto the first, connection end 72 thereof. The first, attachment end 63*a* of the drainage tube 63 is attached to the first valve 61 by push fit into the second, connection socket 61*b*. The second end of the drainage tube 63 is located at or toward a site of waste birthing water disposal or storage. The spillage collector 64 is located beneath the outlet 27 in the floor 20 of the tub 2. The platform 4 and the step apparatus 5 are positioned adjacent the support wall 30 of the stand 3.

In this installed condition, the out-turned lip 22 of the tub 2 has a first height $d_1$ above the ground upon which the stand 3 rests. The out-turned lip 22 of the tub 2 has a second height $d_2$ above the floor 20 of the tub 2 at the second, deep end 26 thereof. The difference between the first and second heights $d_1$, $d_2$ is the distance by which the floor 20 at the deep end 26 of the tub 2 is spaced from the ground upon which the stand 3 rests. In embodiments, the first distance $d_1$ is between about 920 and 1400 mm, say between about 900 or 920 and 1200 mm, for example between 900 and 1100 mm. In embodiments, the second distance $d_2$ is between about 500 and 800 mm. In embodiments, the ratio of the first distance $d_1$ to the second distance $d_2$ is between about 1:1 and 1:2.

Before a mother-to-be uses the apparatus 1 the first valve 61 is closed, to prevent fluid flow therethrough, by hand manipulation of the control member 61*c*. The tub 2 is then filled with water.

A mother-to-be enters the tub 2 by climbing up the step apparatus 5, optionally using the hand rail 51 to aid her balance. The ledge 28 toward the first, shallow end 25 of the tub 2 provides a step within the tub 2 which aids the mother-to-be entering thereinto. An assistant can assist the mother-to-be entering and exiting the tub 2 and during the birthing procedure therewithin. The assistant may be at least partially supported on the platform 4. In particular the assistant may kneel on the platform 4.

Advantageously, by raising the tub 2 relative to the ground or other surface upon which the stand 3 rests, the mother-to-be is relatively higher than she would otherwise be, when she is located in the tub 2, relative to said ground. Accordingly, the vertical distance by which the assistant(s) are required to bend and/or reach during assistance is relatively reduced. Reduction of this bending and/or reaching distance has been found to relatively reduce the risk of injury occurring to the assistant(s) and/or the mother-to-be, and to relatively increase the comfort of the assistants during the birthing procedure.

Provision of the platform 4 adjacent the tub 2 has been found to beneficially aid reaching of the assistant(s) into and/or across the tub 2, in order to assist the mother-to-be. The platform 4 allows the assistant(s) to maintain a more upright position of their upper torso whilst assisting the mother-to-be. The risk of injury (for example to the back(s) of the assistant(s)) is thereby relatively reduced, whilst the assistant(s) are also in a stronger position to aid the mother-to-be such that relatively greater weights may be more readily lifted. Furthermore, provision of the platform 4 reduces the rate at which the assistant(s) become fatigued whilst assisting the mother-to-be. Accordingly, the assistant (s) using the apparatus 1 are less likely to become exhausted than are assistant(s) using prior art birthing pools. Hence, the assistant(s) using the apparatus 1 are less likely to suffer an injury at least partially caused by fatigue.

When the birthing procedure has ended the woman leaves the tub 2. This exit is typically assisted by the assistant(s). The assistant(s) may be at least partially supported on a platform 4 as described above. For example, in embodiments of this invention plural platforms 4 may be provided.

After the birthing process the waste water must be drained from the tub 2. The first valve 61 and the second valve 62 are moved into open positions such that water may flow therethrough.

Raising the tub 2 up from the ground or other supporting surface upon a stand 3 allows the shape of the floor 20 of the tub 2 to be non-parallel relative to the plane $P_1$ defined by the terminal edge 23 of the side walls 21. Beneficially, it has been found that by inclining the floor 20 of the tub 2, with respect to the ground upon which the stand 3 rests, waste water is more effectively drained therefrom. By positioning the outlet 27 in the floor 20 of the tub 2 at a location at or adjacent the second, deep end 26 of the tub 2 a pool of waste water is prevented from remaining within the tub 2 subsequent to draining. Furthermore, by raising the tub 2 up from the ground the potential energy of water contained therein is increased and hence drainage of that water is more readily, completely and/or rapidly accomplished via the effect of gravity.

Raising the tub 2 up off of the ground has also been found to beneficially allow for the use of a relatively less complex drainage apparatus 6, which does not require the use of a pump (in contrast to prior art systems). The drainage apparatus 6 of the invention is entirely gravity fed, using the potential energy of the water within the tub 2 to effect drainage and accordingly does not require the assistance of a pump. Prior art birthing pools which require a pump to effect drainage are necessarily more complex and expensive and relatively more at risk of failure. Accordingly, the apparatus 1 for water birthing according to the invention is less expensive and more reliable than such prior art birthing pools.

The simple arrangement of the drainage apparatus 6 is enabled by the presence of a space underneath the floor 20 of the tub 2, which is itself a consequence of the tub 2 being raised by the stand 3 above the level of the ground. Furthermore, ensuring that the connector 7 is relatively short in length enables the first valve 61 and drainage tube 63 to be attached therebeneath (in use) without fouling the ground upon which the stand is located.

Advantageously, it has been found that the relatively simple drainage apparatus 6 according to the invention allows for more rapid and complete cleaning of the apparatus 1 for water birthing than is the case with prior art drainage systems. Due to the push-fit connection between the various components the drainage apparatus 6 can be rapidly disconnected and disassembled after use, thereby providing a quick release drainage system 6. Furthermore, because the drainage tube 63 is inexpensive (due in part to being formed from inexpensive materials) it may be disposed of after a single use. Consequently, the drainage tube 63 does not require cleaning, further speeding up the cleaning process. Moreover, the first valve 61 and the connector 7 have an uncomplicated shape which is well-suited to rapid and effective cleaning. In particular, the smooth bore of the connector 7 aids with cleaning thereof. In embodiments, the first valve 61 may not be provided and, instead, the flow of fluid through the drainage apparatus 6 may be controlled by the second valve 62 only. In this way, the drainage apparatus 6 may be simplified even further and consequently the cleaning process may be sped up yet further.

Ensuring that the drainage apparatus 6 is accessible during use, enables the open/closed condition of the first valve 61 to be easily seen and, furthermore, this condition can be rapidly altered as desired (for example in the event of an emergency). Furthermore, the drainage apparatus 6 is consequently more easily and/or rapidly connected and disconnected from the connector 7. The apparatus 1 may, therefore, be more easily installed at a site of use without the need for more substantial, permanent and/or expensive plumbing arrangements.

Beneficially, the drainage apparatus 6 according to the invention does not require the use of electricity. Prior art birthing apparatus which utilize electrically driven pumps in order to drain waste water from a tub necessarily require electrical connection. As will be appreciated, the juxtaposition of water and electricity increases the risk of injury to persons nearby by electric shock. By removing the requirement for an electrically driven pump, the apparatus 1 for water birthing according to the invention mitigates this risk.

Provision of a support wall 30 on the stand 3 which extends around a major portion (and in this embodiment the entirety) of the side wall 21 of the tub 2 provides a protective barrier against impact damage of the side wall 21.

Figure 9:
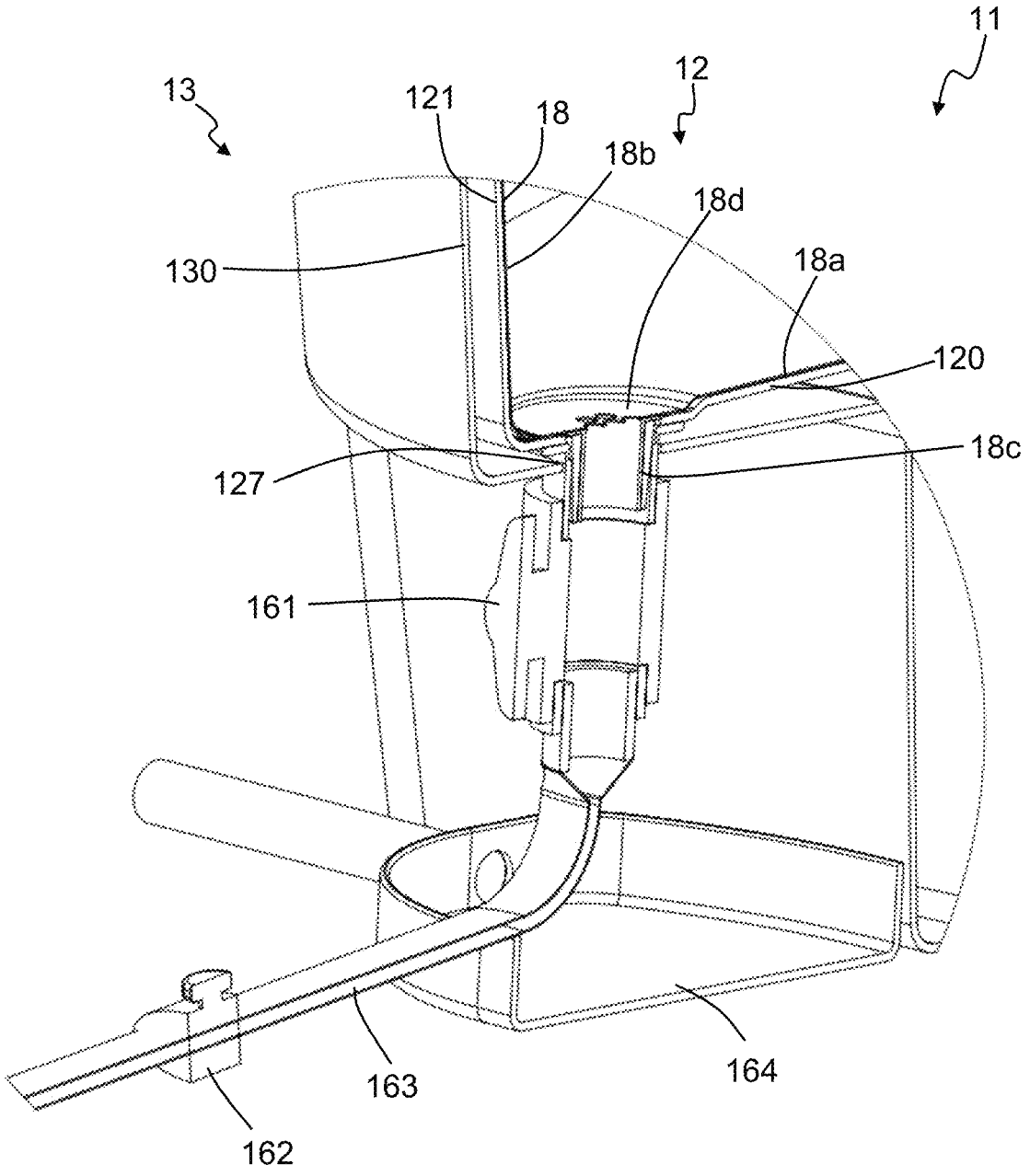
FIG. 9 is a partial sectional view of an apparatus for water birthing according to an alternative embodiment of the invention.

Referring now to FIG. 9, there is shown part of an apparatus for water birthing 11 according to an alternative embodiment of the invention, wherein like features are identified by like references preceded by a '1', which will not be described herein further. The apparatus 11 shown in FIG. 9 differs from that shown in FIG. 1 in that a removable liner 18 is provided.

The removable liner 18 comprises a base portion 18*a* from peripheral edges of which a wall portion 18*b* extends. The wall portion 18*b* comprises a rim (not shown) which is configured to engage, in use, the out-turned lip 122 of the tub 12. The removable liner 18 is sized and shaped to closely conform to the internal surfaces of the tub 12, for example such that the removable liner 18 lines said internal surfaces.

The removable liner 18 comprises an outlet port 18*c* extending from the base portion 18*a* and arranged to align with the outlet 127 through the floor 120 of the tub 12 when the removable liner 18 is installed thereinto. A screen member 18*d*, which in this embodiment is a grill 18*d*, is located inside the bore of the outlet port 18*c*. When the removable liner 18 is installed in the tub 12 the outlet port 18*c* projects through the outlet 127 in the floor 120 of the tub 12. The outlet port 18*c* may comprise a seal 18*e* on an outer surface thereof for sealing between the outlet port 18*c* and the outlet 127 in the floor 120 of the tub 12.

Beneficially, after using the apparatus for water birthing, the removable liner 18 is rapidly and easily removable from the tub 12. The removable liner 18 may be disposed of after use, thereby beneficially further speeding up the process of cleaning the apparatus 11.

The screen member 18*d* of the removable liner 18 and/or the removable liner 18 itself may usefully retain matter for further analysis. In such a circumstance the removable liner 18 may not be disposed of after use but may instead be retained so that the contents thereof may be analysed.

Figure 10:
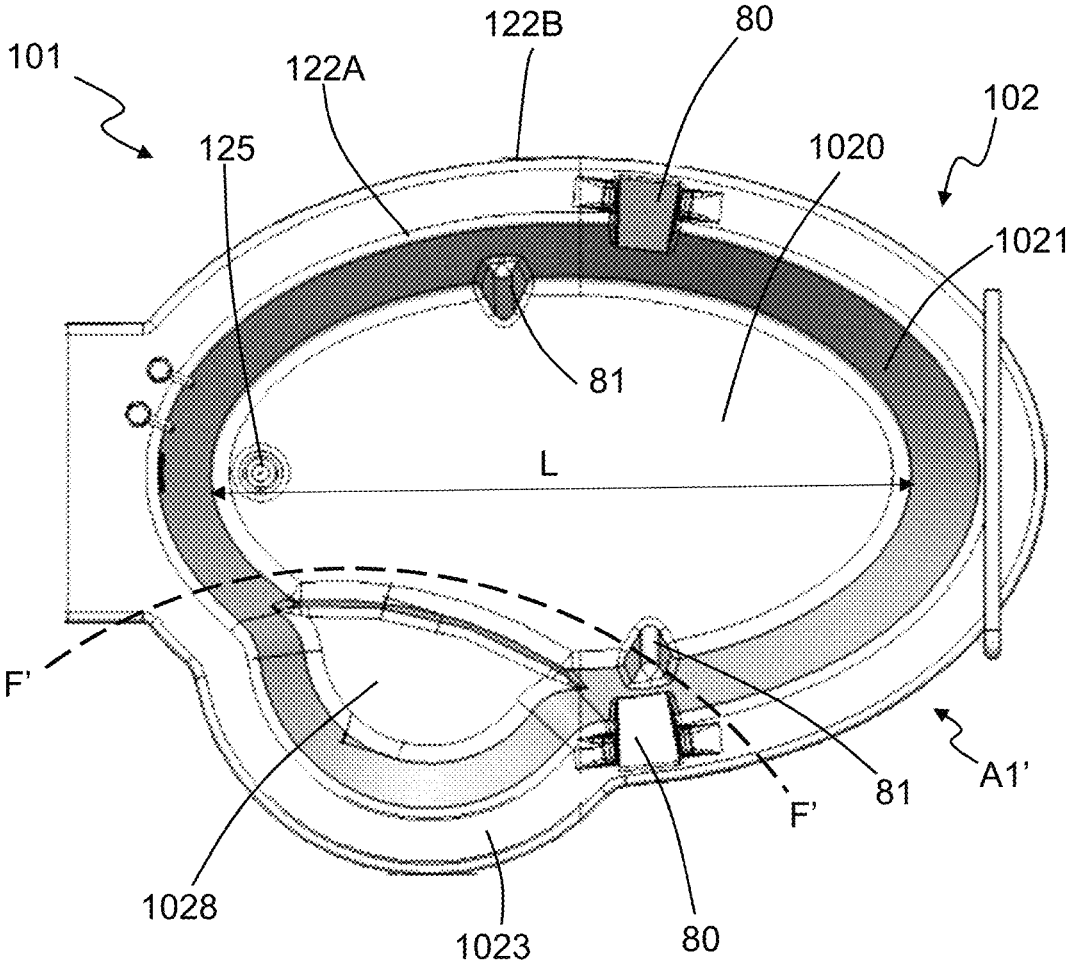
FIG. 10 is a plan view of an apparatus for water birthing according to an alternative embodiment of the invention.
Figure 11:
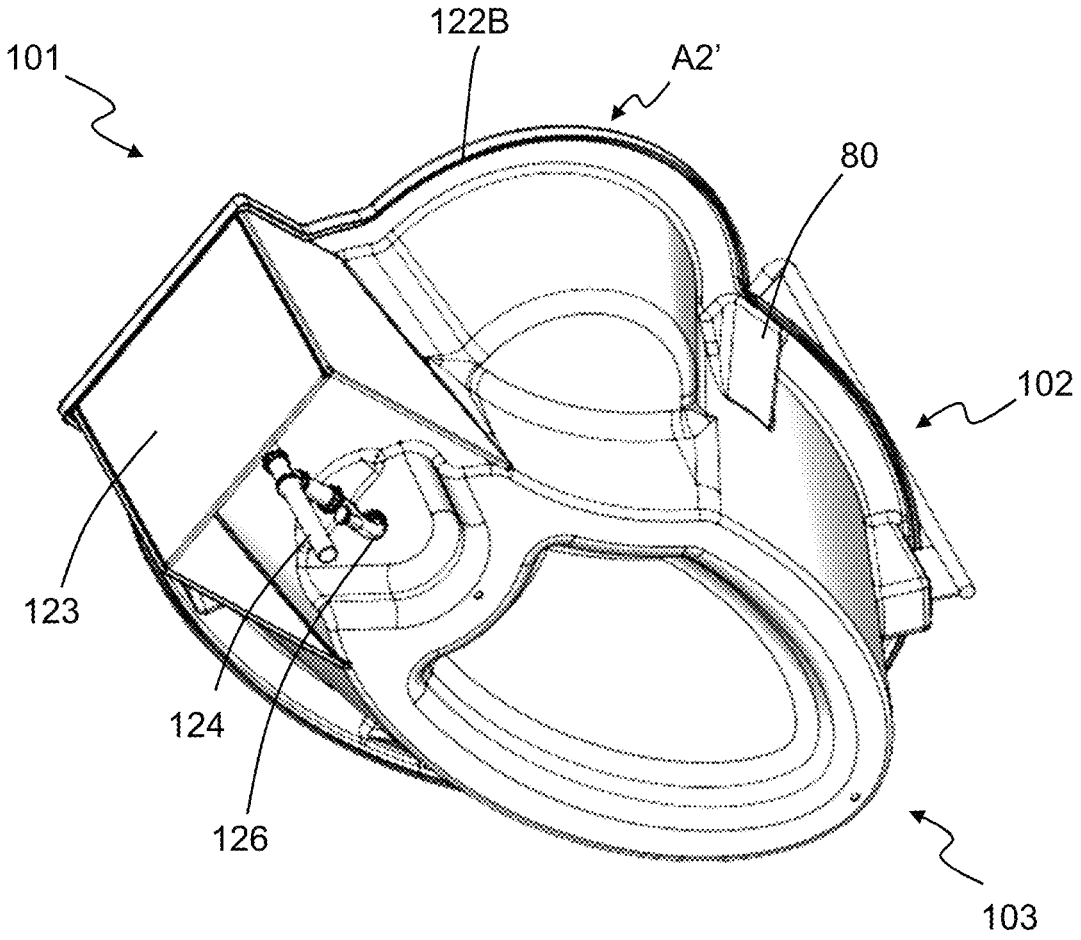
FIG. 11 is a perspective view of the apparatus shown in FIG. 10.

Referring now to FIG. 10 and FIG. 11, there is shown an apparatus for water birthing 101 according to an alternative embodiment of the invention. A apparatus 101 comprises a tub 102, a stand 103 and drainage apparatus 124. The tub 102 is shown comprising a floor 1020, an internal ledge 1028, a side wall 1021 and a terminal edge 1023. An outlet 125 extends through the floor 1020 of the tub 102. The apparatus 101 comprises a connector 126 for connecting the outlet 125 of the tub 102 to the drainage apparatus 124. The stand 103 comprises a drainage housing 123, in this embodiment.

A stair apparatus (shown as integer 5 in FIG. 6) and a platform (shown as integer 4 in FIG. 6) for kneeling are not shown but may also be included with the apparatus 101, if desired.

In this embodiment, the drainage apparatus 124 comprises overflow pipework. However, if desired, the overflow pipework may be omitted from this embodiment. In this embodiment, the drainage apparatus 124 may be reusable, for example one or more component thereof may be reusable. However, if desired the apparatus 101 may comprise drainage apparatus 6 similar to that described in respect of FIG. 1.

The drainage housing 123 is positioned to at least partially enclose the drainage apparatus 124. The drainage housing 123 comprises an openable or removable portion, thereby providing access to the drainage apparatus 124 whilst the apparatus for water birthing 101 is in use. In embodiments of this invention, one or more portion or panel of the drainage housing 123 may be hingeably attached to the remainder of the drainage housing 123 and/or to the stand 103. In this way the drainage apparatus 124 may be protected (for example from damage from impacts) whilst still remaining accessible during use of the apparatus 101. In embodiments. However, within broader aspects of this invention the drainage housing 123 may be omitted from the apparatus 101.

The tub 102 further comprises orientation points 80 and bracing portions 81. The orientation points 80 comprise rebates extending into the tub's 101 side wall 1021 and terminal edge 1023. The bracing portions 81 comprise projections upstanding from the tub 101. The projections comprise ribs, in this embodiment. The bracing portions 81 are located at the intersection of the floor 1020 and the side wall 1021 of the tub 102. In this embodiment, the bracing portions 81 are formed integrally with the tub 102. However, if desired, the bracing portions 81 may be attached or attachable to the tub 102.

Advantageously, the orientation points 80 and/or bracing portions 81 may provide hand holds and/or foot holds for the birthing mother to grip and/or push against whilst moving into, out of, and/or within the tub 102. This enables greater manoeuvrability around and within the tub 102 by providing a secure and stable weight bearing point for supporting the birthing mother. Further, a birthing mother may position and/or reposition herself more rapidly and/or precisely through use of the orientation points 80 and/or bracing portions 81. Additionally, an assistant may grip or otherwise engage the orientation points 80, for example whilst leaning into the tub to provide help to the mother and/or baby during labour and/or birth. Further, a birthing mother may at least partially brace or otherwise support herself against one or more of the orientation points 80 and/or bracing portions 81.

An inner rebate 122A and an outer rebate 122B are also provided on the tub 102 as an additional means for the birthing mother to grip with either her hands or feet. These may be used as weight bearing points for the birthing mother to use to provide stability and comfort when she is sitting or lying in different positions, and also provide greater control when moving within the tub 102.

The apparatus 105 shown in FIG. 10 differs from that shown in FIG. 6 in that the tub has a different shape in plan view, with the ledge 1028 (ledge 28 in FIG. 6) located at a side of the tub 102. The shape of the tub 102 is now a distorted oval shape, in plan, comprising an immersion area A1' and a support area A2' (divided by line F'). The length L of the tub 102 is not obstructed or hindered by the ledge 1028. Advantageously, this design provides a relatively large space for the birthing mother to have freedom of movement, allowing her to stretch out and rest against the internal surfaces of the side wall 1021 using the entire length L of the tub 102, without needing to rest against the ledge 1028. The embodiment shown in FIGS. 10 and 11 may be preferred by some birthing mothers, whereas others may prefer the embodiment shown in FIG. 6, in which the ledge 28 is located at the end of the tub 2.

In certain embodiments, the tub of FIGS. 10 and 11 may have a lower profile (e.g. height above the ground) than do the tubs of earlier embodiments. In certain embodiments the tub may have a terminal edge which is spaced from the surface upon which the stand rests by say 700 to 1000 mm, preferably from 700 to 800 mm.

It will be appreciated by those skilled in the art that several variations to the aforementioned embodiments are envisaged without departing from the scope of the invention. For example, although the tub 2, 12, stand 3, 13, platform 4 and stair apparatus 5 are shown as being separate components they need not be and instead some or all of the components may be fixed to or integral with one another.

Additionally or alternatively, the support wall 30, 130 of the stand 3, 13 may be absent a recessed portion 38, 138 and may instead comprise a cut-out portion at the second end 37 of the stand 3, 13. Additionally or alternatively, the drainage apparatus 6, 16 may be provided without either the first or second valve 61, 161, 62, 162.

Additionally or alternatively, more than one platform 4 may be provided.

Orientation points and/or bracing portions may be provided on any of the aforementioned embodiments.

It will also be appreciated by those skilled in the art that any number of combinations of the aforementioned features and/or those shown in the appended drawings provide clear advantages over the prior art and are therefore within the scope of the invention described herein.

The invention claimed is:

1. An apparatus for water birthing, the apparatus comprising a tub, a stand and a connector, wherein the tub is configured to be separable from the stand and is separable from the stand, the tub having a floor with an outlet therethrough and a peripheral side wall, the stand being configured to removably support the tub, in use, at or adjacent a terminal edge or lip of the peripheral side wall such that the floor of the tub is spaced from the ground upon which the stand rests, wherein the connector is fluidly connected or configured to be connected to the outlet at a first end thereof, a second end thereof being removably and fluidly connected or configured to be connected to a drainage apparatus, the stand comprising a recessed portion into which the second end of the connector extends, said second end of the connector being accessible through said recessed portion and is accessible during use of the water birthing apparatus.

2. An apparatus according to claim 1, wherein, when the tub is supported by the stand, in use, the terminal edge of the peripheral side wall of the tub has a height of greater than 920 mm above the floor or other surface upon which the stand rests.

3. An apparatus according to claim 1, wherein the tub comprises an out-turned lip at the terminal edge, the out-turned lip being configured to be engaged, in use, by an abutment member of the stand to thereby support the tub.

4. An apparatus according to claim 3, wherein the stand comprises one or more support members having a ground engaging member at one edge and the abutment member at the opposed edge.

5. An apparatus according to claim 4, wherein the one or more support members comprise a support wall configured, in use, to surround the peripheral side wall of the tub.

6. An apparatus according to claim 1, wherein the floor of the tub comprises a sloped portion inclined relative to the floor or other surface upon which the stand rests, when the tub is supported by the stand, in use.

7. An apparatus according to claim 6, wherein the outlet is through the sloped portion of the floor of the tub.

8. An apparatus according to claim 1, wherein the stand comprises an aperture for passage therethrough of the connector, where the stand is arranged or configured to be arranged, in use, such that when the stand supports the tub the outlet of the tub is aligned with or adjacent to the aperture of the stand.

9. An apparatus according to claim 1, comprising a removable drainage apparatus attached or configured to be attached to the connector.

10. An apparatus according to claim 9, wherein the removable drainage apparatus is attached or configured to be attached to the connector by push fit.

11. An apparatus according to claim 9, wherein the removable drainage apparatus comprises a valve arranged or configured to be arranged to selectively allow or prevent fluid flow through the outlet.

12. An apparatus according to claim 1, comprising a screen arranged or configured to be arranged to filter fluid flow, in use, through the outlet.

13. An apparatus according to claim 1, wherein the tub comprises an internal ledge for seating an occupant of the tub, in use, and/or for aiding ingress into and/or egress from the tub.

14. An apparatus according to claim 13, wherein the internal ledge is integral with the tub.

15. An apparatus according to claim 1, comprising a removable liner configured to line, in use, the internal surfaces of the tub.

16. An apparatus according to claim 15, wherein the removable liner comprises a base portion from peripheral portions of which a wall portion extends, the base portion comprising a screen arranged to filter fluid flow and positioned in the base portion such that, when the liner is arranged to line the internal surface of the tub the screen is aligned or configured to be aligned with the outlet through the floor of the tub.

17. An apparatus according to claim 16, wherein the screen is non-removably attached to the base portion of the removable liner.

18. An apparatus according to claim 1, wherein the tub and/or the stand are formed from a polymer.

19. An apparatus according to claim 1, wherein the tub and/or the stand are formed by moulding, e.g. by injection moulding or by rotational moulding.

20. An apparatus for water birthing according to claim 1, wherein the recessed portion of the stand comprises an aperture through which the second end of the connector extends.

* * * * *